United States Patent [19]

Schwankl

[11] Patent Number: 4,823,975

[45] Date of Patent: Apr. 25, 1989

[54] CAN CLOSURE

[76] Inventor: Lynn R. Schwankl, 5833 Eleventh Ave. South, Minneapolis, Minn. 55417

[21] Appl. No.: 202,378

[22] Filed: Jun. 6, 1988

[51] Int. Cl.[4] ..... B65D 6/12; B65D 6/14; B65D 25/00

[52] U.S. Cl. ..... 220/85 H; 220/277; 220/278

[58] Field of Search ..... 220/200, 277, 278, 85 H; 81/3.32, 3.3

[56] References Cited

U.S. PATENT DOCUMENTS

| | | | |
|---|---|---|---|
| 308,686 | 12/1884 | Merrill . | |
| 677,733 | 7/1901 | Bray . | |
| 1,022,591 | 4/1912 | Perry . | |
| 1,842,210 | 5/1929 | Scruton . | |
| 1,929,334 | 12/1932 | Sabatine | 81/3.3 |
| 2,466,937 | 4/1949 | Downs | 144/305 |
| 3,158,879 | 12/1961 | Barrett | 7/14.6 |
| 3,159,064 | 3/1962 | Woloszyn | 81/3.32 |
| 4,127,211 | 11/1978 | Zerley | 220/85 H |
| 4,494,672 | 1/1985 | Pearson | 220/85 H |
| 4,651,988 | 3/1987 | Sobel | 220/85 H |

*Primary Examiner*—George T. Hall
*Attorney, Agent, or Firm*—Palmatier & Sjoquist

[57] ABSTRACT

A can closure for a cylindrical can containing a carbonated beverage or drink typically to be opened at the can top which suitably has a rim thereabout. A can cover plate is provided having an underside surface sealably engagable with the can top rim. A can support plate is oriented below and opposing the can cover plate and is designed for supporting the can. An expansible back connects the can cover and support plates in expansible and contractible opposing relation to permit the can closure to close down upon and sealably engage the can top rim. A locking mechanism is provided to secure the expansible back once the can cover plate is sealably engaged with the can top rim.

14 Claims, 5 Drawing Sheets

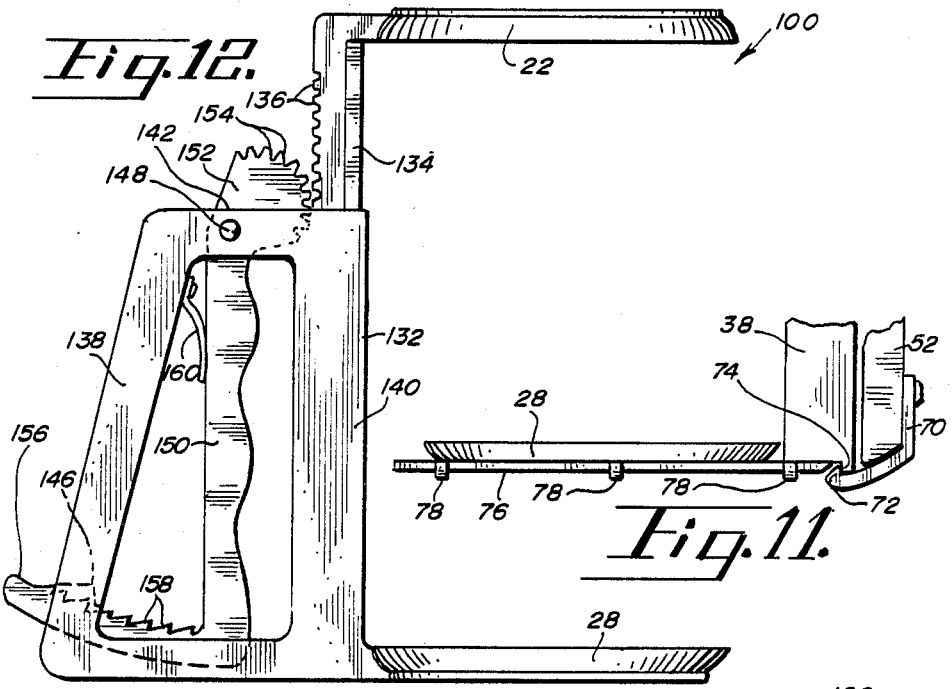
Fig.12.
Fig.11.
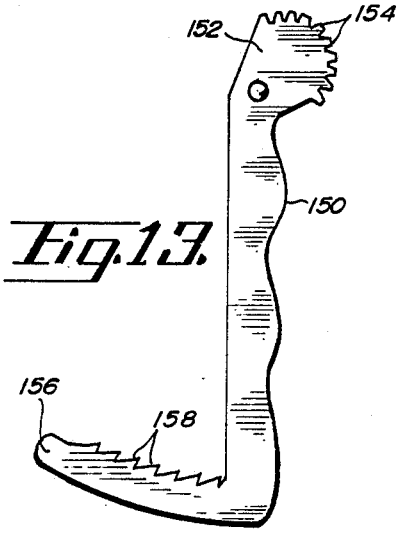
Fig.13.
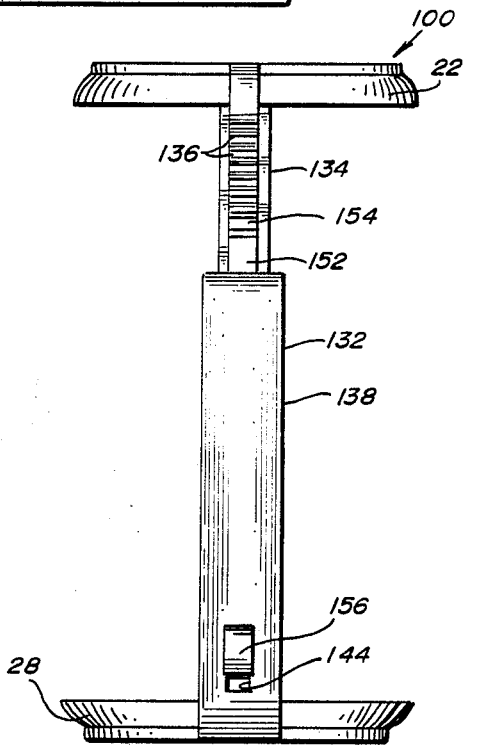
Fig.15.

CAN CLOSURE

BACKGROUND OF THE INVENTION

The present invention relates to a device for temporarily sealing a cylindrical can containing a carbonated beverage which commonly opens at the can top and which has a rim about the can top.

It is well known that carbonated beverages and drinks have their sparkling effect due to their carbon dioxide content. With continued exposure to the ambient atmosphere, such carbonated beverages will become flat or loose their sparkling or fizzle effect rendering the particular beverage seemingly less flavorful or palatable.

Carbonated beverages contained in bottles with removable caps lend themselves for easy resealing of the bottle. That is, some bottle caps are of the screw-on and screw-off type which permit resealing of the bottle. Other bottles permit plastic caps to be placed over the lip of the bottle opening to thereby seal in the freshness or carbonation of the beverage within the bottle.

Cylindrical cans both made of steel and aluminum have posed a special problem in that they do not lend themselves to be readily resealed once the can top has been opened either by action of a can opener or a can top tab. Consequently, the beverage must be completely consumed or stored in another sealable container to prevent the remaining carbonated beverage from going flat.

There is a need for a device to temporarily close beverage cans as to seal in their freshness and carbonation for individuals who do not wish to completely consume the entire can's contents or store the beverage in another sealable container.

SUMMARY OF THE INVENTION

A can closure for a cylindrical can containing a carbonated beverage or drink typically to be opened at the can top which suitably has a rim thereabout. A can cover plate is provided having an underside surface sealably engagable with the can top rim. A can support plate is oriented below and opposing the can cover plate and is designed for supporting the can. An expansible back connects the can cover and support plates in expansible and contractible opposing relation to permit the can closure to close down upon and sealably engage the can top rim. A locking mechanism is provided to secure the expansible back once the can cover plate is sealably engaged with the can top rim.

A principal objective and advantage of this invention is that it provides a can closure device which will readily seal a cylindrical can containing carbonated beverages when either all of the beverage is not consumed or when it is undesirable to transfer the beverages to another sealable container.

Another objective of the present invention is to provide a can closure that is adjustable for various sizes of cans thereby rendering the can closure more readily universal in its application.

Another principal advantage of the present invention is that the can closure is simple in structure, inexpensive to manufacture and easy to operate.

BRIEF DESCRIPTION OF THE DRAWINGS

FIG. 11 is a broken away view of a locking mechanism embodiment of the present invention;

FIG. 12 is a side elevational view of a modified form of the can closure;

FIG. 13 is a side elevational view of the lever of the modified form of the can closure;

FIG. 15 is a rear elevational view of the modified can closure; and

DETAILED SPECIFICATION

Figure 1:
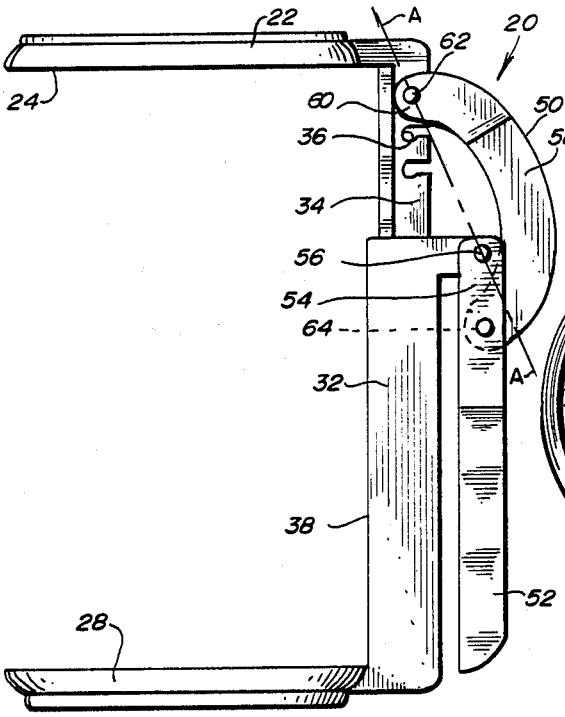
FIG. 1 is a side elevational view of the can closure of the present invention.
Figure 5:
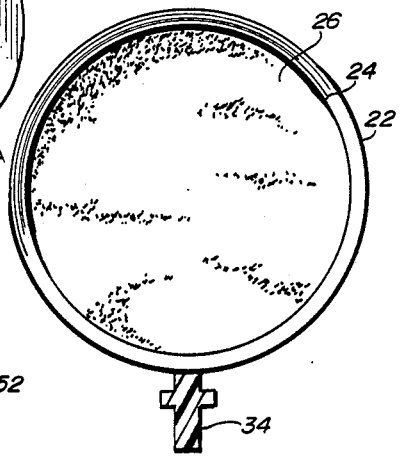
FIG. 5 is a sectional view taken along lines 5—5 of FIGS. 2 and 3.
Figure 4:
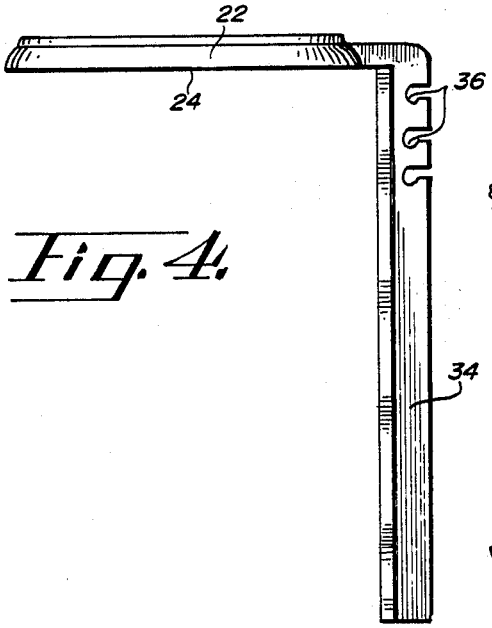
FIG. 4 is a side elevational view of the can cover plate and upper back member.
Figure 2:
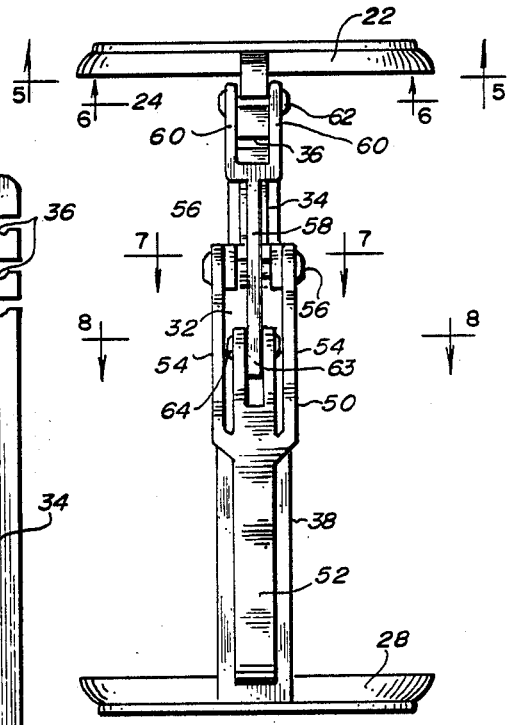
FIG. 2 is a rear elevational view of the can closure.
Figure 3:
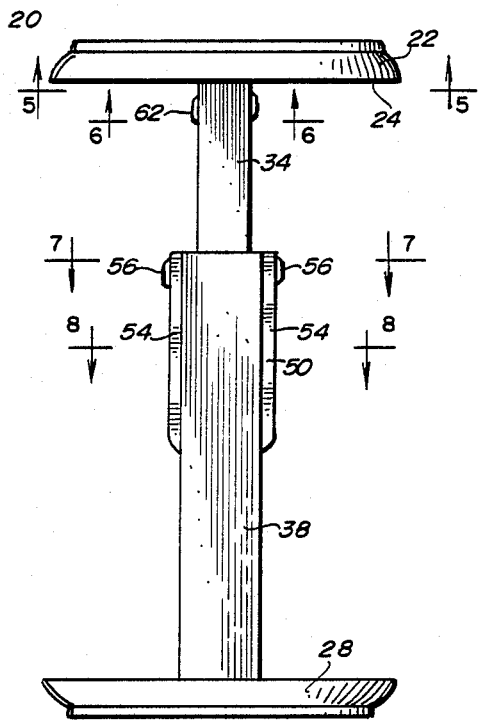
FIG. 3 is a front elevational view of the can closure.
Figure 6:
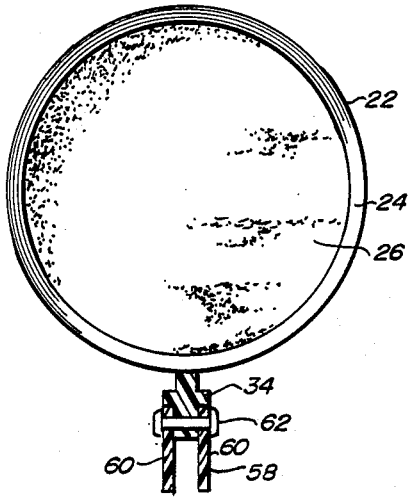
FIG. 6 is a cross sectional view taken along lines 6—6 of FIGS. 2 and 3.
Figure 7:
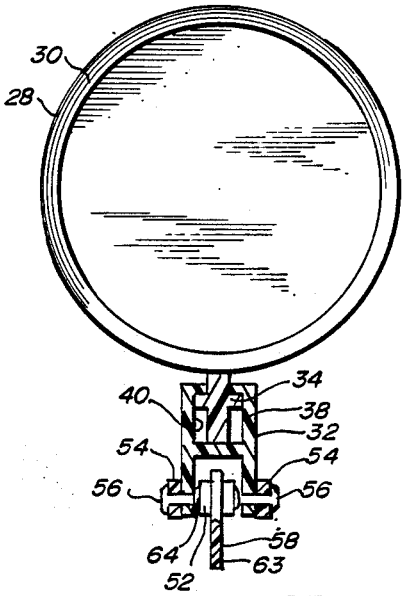
FIG. 7 is a cross sectional view taken along lines 7—7 of FIGS. 2 and 3.
Figure 8:
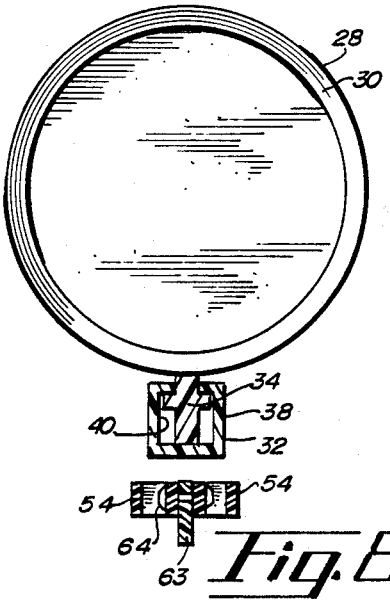
FIG. 8 is a cross sectional view taken along lines 8—8 of FIGS. 2 and 3.

Beverage cans 10 (FIG. 9) typically include a can top 12 with a raised rim 13 thereat. Some can tops are typically opened for access to the liquid therein by tab 14 which forms tab opening 16 or otherwise may be opened by a can opener thereby forming a can opener hole 18.

As can be viewed in FIGS. 1–10, the can closure 20 of the present invention generally includes a can cover plate 22 interconnected with a can support plate 28 by an expansible back 32. The can closure 20 also has a locking mechanism 50 for holding the can cover plate 22 in sealed engagement with the rim of the top of the can 10 to be sealed. Can closure 20 can readily and economically be molded from plastic such as high impact styrene or any other material which will render the can closure 20 to be lightweight, durable and not readily subject to breakage.

Can cover plate 22 has an underside surface 24 which has mounted thereon a nonporous resilient foam 26 or the like which will enable sealable engagement with rim 13 of can 10 so that gas (carbon dioxide) cannot escape leave the can 10 nor will ambient atmosphere be permitted to continuously flow through can 10. Can support plate 28 suitable has an indexing ring 30 which readily permits proper alignment of can 10 within can closure 20 so that can cover plate 22 will fit over rim 13 and seal can 10.

Can cover plate 22 and can support plate 28 are appropriately interconnected by an expansible back 32. Back 32 includes an upper back member 34 which may be integral with can cover plate 22. Upper back member 34 appropriately has notches 36 along its back side more fully discussed below. Expansible back 32 also includes lower back member 38 which similarly may be integral with can support plate 28 and which preferable has a hollow interior or inside 40.

By this arrangement, can cover plate 22 and can support plate 28 may be vertically and opposingly oriented with respect to each other in an expanding or contracting relationship as upper back member 34 telescopes within a hollow interior 40 of lower back member 38.

Locking mechanism 50 appropriately has lever 52 which is preferably "Y" or wishbone in shape having upper ends 54 with pivot pins 56 suitable mounting ends 54 on lower back member 38 to permit pivotal movement of lever 52 with respect to the expansible back 32. Toggle link 58 is appropriately "Y" or wishbone in shape having upper ends 60 with a pivot pin 62 appropriately mounted therebetween. Pivot pin 62 suitably will slide into and out of notches 36. Toggle link 58 also has a lower end 63 having a pivot pin 64 appropriately thereat for suitable pivot mounting to lever 52.

By this construction, back 32 is permitted to controllably expand for variously sized cans, such as 12 ounce and 16 ounce can sizes. Locking mechanism 50 appropriately allows such expansion or contraction by simply sliding pin 62 into the appropriate notch 36 on upper back member 34 for the particular size of can 10.

Figure 9:
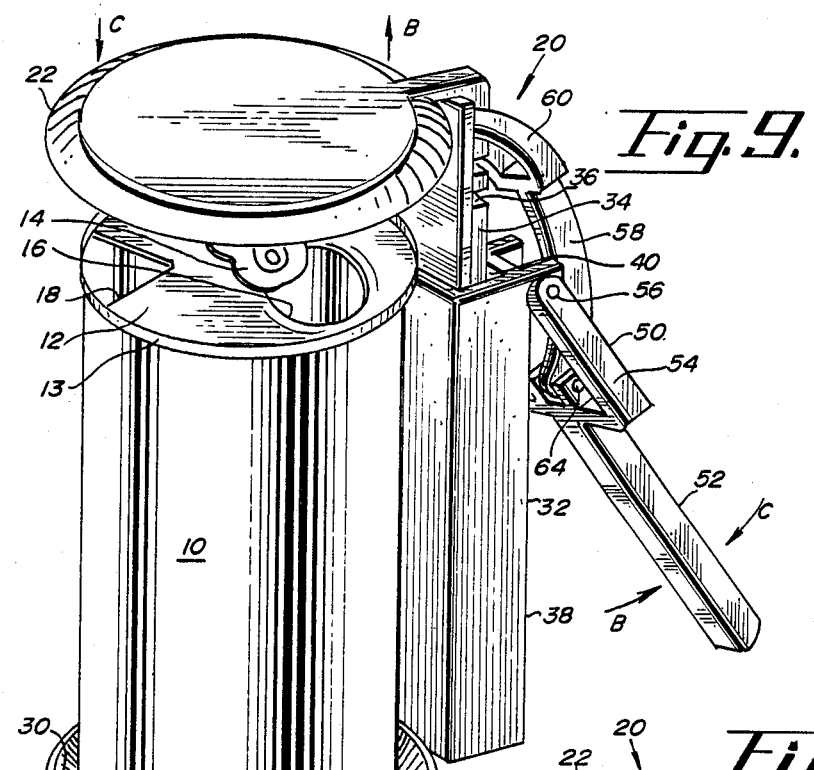
FIG. 9 is a perspective view of the can closure in open position with a can placed therein.
Figure 10:
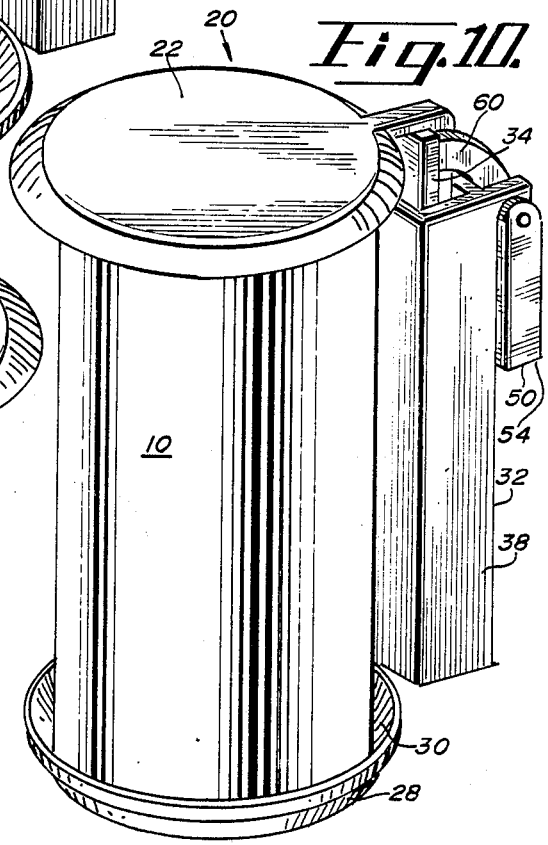
FIG. 10 is a perspective view of the can closure closed down upon the can.
Figure 14:
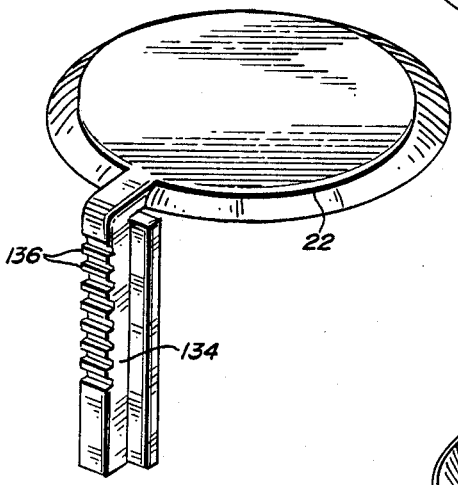
FIG. 14 is a perspective view of the can cover plate and upper back member of the modified form of the can closure.

Locking mechanism 50 is preferably self-locking in operation as may be understood in FIGS. 1, 9 and 10. Noting that line A—A extends from pivot 62 through pivot 56, lever 52 is initially lifted upwardly (arrow B) to permit expansion of can cover plate 22 with respect to can support plate 28. Thereafter, can 10 is set on can support plate 28 as indexing ring 30 appropriately assures proper alignment of can 10 on plate 28. Subsequently, lever 52 is moved downwardly (arrow c) until pivot pin 64 passes beyond line A—A through pivot points 62 and 56 to appropriately work as a cam over self-locking arrangement.

Referring to FIG. 11, another embodiment of locking mechanism 50 may include a latch 70 appropriately connected to the bottom of lever 52 having a detent nib 72 at its remote end which will releasably interconnect with catch 74 on lower back member 38. Release bar 76 may be slidably mounted in guides 78 on the underside of can support plate 28. When lever 52 is brought down to seal can cover plate 22 upon rim 13 of can 10, detent nib 72 of latch 70 may releasably interconnect with catch 74. Release of latch 70 is performed by sliding release bar 76 with a finger or thumb to disengage detent nib 72 with catch 74 there after permitting lever 52 its upward pivotal motion to release can 10 from can closure 20.

FIGS. 12–16 show another embodiment of can closure 100 of the present invention wherein can cover plate 22 and can support plate 28 are essentially the same as those of can closure 20.

Expansible back 132 includes upper back member 134 having a rack surface 136 thereon. Handle locking mechanism 138 includes hollow back member 140, upper lever aperture 142 and lower lever aperture 144 with catch 146 at aperture 144. Lever pivot pin 148 is appropriately mounted adjacent upper lever aperture 142. Lever 150 is pivotally mounted at lever pivot pin 148 intermediately having locking head 152 with teeth 154 which protrudes from upper lever aperture 142 adjacent rack surface 136 of upper back member 134. The lower end 156 of lever 150 also has teeth 158 thereat to releasably engage catch 146 in handle locking mechanism 138. End 156 is preferably biased away from catch 146 by spring 160.

Figure 16:
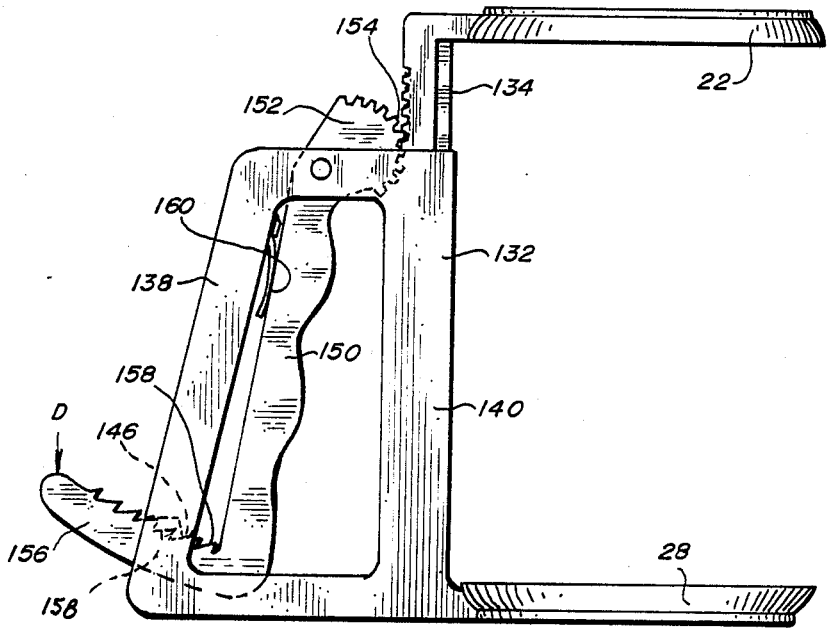
FIG. 16 is a side elevational view of the modified can closure in its locked down position.

Operation of the modified can closure 100 may be seen in FIGS. 12 and 16. Essentially, can cover plate 22 is lifted upwardly when teeth 154 of locking head 152 are not engaged with rack 136 of upper back member 134. Thereafter, can 10 is inserted within can closure 100 and can cover plate 28 is manually forced downward to seal upon rim 13. Handle 138 is then manually grasped as lever 150 is pulled With fingers to engage lower lever end 156 with teeth 158 with catch 146 and teeth 154 of locking head 152 with rack surface 136 of upper back member. To release lever 150, a downward force (arrow D) is exerted upon the lever catch release end 156 to permit pivotal movement of lever 150 and disengagement of locking head 152 with upper back member 154.

The present invention may be embodied in other specific forms without departing from the spirit or essential attributes thereof, and it is therefore desired that the present embodiment be considered in all respects as illustrative and not restrictive, reference being made to the appended claims rather than the foregoing description to indicate the scope of the invention.

What is claimed:

1. A can closure for a cylindrical can typically to be opened at the can top having a rim thereabout and characteristically containing carbonated beverages, drinks or the like which otherwise may go flat or spoil if the can is left in its once opened condition for an extended length of time, comprising (a) a can cover plate having an underside surface sealably engageable with the can top rim;

(b) a can support plate oriented below and opposing the can cover plate for appropriately supporting the can;

(c) an expansible back connecting the can cover and support plates in expansible and contractible opposing relation to permit the can closure to close down upon and sealably engage the can top rim; and (d) a locking mechanism to secure the back once the can cover plate is sealably engaged with the can top rim.

2. The can closure of claim 1 wherein the can clover plate has an underside that is resilient and nonporous for sealable engagement with the can top rim.

3. The can closure of claim 1 wherein the can support plate has a can indexing ring on its upper side to assure proper can alignment within the can closure.

4. The can closure of claim 1, wherein the expansible back comprises an upper back member affixed to the can cover plate and a lower back member affixed to the can support plate, the members being slidably interlockable to permit telescopic movement of the members to thereby permit the plates to expand or contract with respect to each other.

5. The can closure of claim 4 wherein one of the members is hollow to permit the other member to telescopically slide longitudinally within the hollow member to thereby permit the plates to expand or contract with respect to each other.

6. The can closure of claim 4 wherein the locking mechanism comprises a lever pivotally connected to the lower back member and a toggle link having an upper end adjustably and pivotally connected to the upper back member and a lower end pivotally connected to the lever.

7. The can closure of claim 6 wherein the locking mechanism is adapted to lock the can cover plate and can support plate with respect to each other when the lower pivotal end of the toggle link passes a line drawn from the pivotal connection of the toggle link to the upper back member to the pivotal connection of the lever to the lower back member.

8. The can closure of claim 6 wherein the locking mechanism further comprises a latch with a detent nib affixed to the lever which interlocks with a catch on the lower back member.

9. The can closure of claim 4 wherein the locking mechanism further comprises, a handle affixed to the lower back member and a lever pivotally mounted adjacent the handle having a locking head with teeth lockably engageable with the upper back member adapted for such engagement and a lever end opposite the locking head adapted for interlockable engagement with the handle to effectively and releasably interlock the can top and can support plates with respect to each other.

10. The can closure of claim 9 wherein the lever is biased towards its unlocked position.

11. A can closure for a cylindrical can typically to be opened at the can top having a rim about the can top and containing carbonated beverages, drinks or the like which may go flat or spoil if left in the once opened can for an extended length of time, comprising (a) a can cover plate having an underside surface sealably engageable with the can top rim;

(b) a can support plate oriented below and opposing the can cover plate for appropriately supporting the can;

(c) an expansible back connecting the can cover and support plates in expansible and contractible opposing relation to permit the can closure to close down upon and sealably engage the can top rim comprising an upper back member affixed to the can cover plate and a lower back member affixed to the can support plate, the members being slidably interlocked to permit telescopic movement of the members to thereby permit the plates to expand or contract with respect to each other; and (d) a locking mechanism to secure the back once the can cover plate is sealably engaged with the can top rim comprising a lever pivotally connected to the lower back member and a toggle link with an upper end adjustably and pivotally connectable to the upper back member and a lower end pivotally connected to the lever.

12. The can closure of claim 11 wherein the locking mechanism is adapted to lock the can cover plate and can support plate with respect to each other when the lower pivotal end of the toggle link passes a line drawn from the pivotal connection of the toggle link to the upper back member through the pivotal connection of the lever to the lower back member.

13. The can closure of claim 11 wherein the locking mechanism further comprises a latch with a detent nib affixed to the handle which interlocks with a catch on the lower back member.

14. A can closure for a cylindrical can typically to be opened at the can top having a rim about the can top and containing carbonated beverages, drinks or the like which may go flat or spoil if left in the once opened can for an extended length of time, comprising (a) a can cover plate having an underside surface sealably engageable with the can top rim;

(b) a can support plate oriented below and opposing the can cover plate for supporting the can;

(c) an expansible back connecting the can cover and support plates in expansible and contractible opposing relation to permit the can closure to close down upon and sealably engage the can top rim comprising an upper back member affixed to the can cover plate and a lower back member affixed to the can support plate, the members being slidably interlockable to permit telescopic movement of the members to thereby permit the plates to expand or contract with respect to each other; and (d) a locking mechanism to secure the back once the can cover plate is sealably engaged with the can top rim comprising a handle affixed to the lower back member and a biased lever pivotally mounted adjacent the handle having a locking head with teeth lockably engageable with the upper back member adapted for such engagement and a lever end opposite the locking head adapted for interlockable engagement with the handle to effectively and releasably interlock the can top and can support plates with respect to each other.

* * * * *